US006435915B1

(12) United States Patent
Chen

(10) Patent No.: US 6,435,915 B1
(45) Date of Patent: Aug. 20, 2002

(54) PLUG CONNECTOR

(75) Inventor: Chun-Yuan Chen, Taipei Hsien (TW)

(73) Assignee: L&K Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 09/607,855

(22) Filed: Jun. 29, 2000

(51) Int. Cl.[7] ..... H01R 13/648
(52) U.S. Cl. ..... 439/610
(58) Field of Search ..... 439/610, 607–609, 439/687, 696, 906

(56) References Cited

U.S. PATENT DOCUMENTS 5,797,771 A * 8/1998 Garside ..... 439/610
5,820,412 A * 10/1998 Koegel et al. ..... 439/610
5,836,774 A * 11/1998 Tan et al. ..... 439/610

* cited by examiner

*Primary Examiner*—Gary F. Paumen
(74) *Attorney, Agent, or Firm*—Pro-Techtor International Services

(57) ABSTRACT

A charger plug of the present invention comprises an insulative casing, a terminal unit received within the insulative casing, a conductive terminal received in the terminal unit, and a shielding unit. The terminal unit includes a longitudinal length and defines an elongated opening along the longitudinal length. The shielding unit covers the longitudinal length and have a second terminal extended from the side of the longitudinal length, moreover, between the terminal and the insulative casing have a embedding groove and a projected jut, and which have a joining post and a joining groove disposed on the insulative casing, such structures can be securely assembled into the terminal unit and the insulative casing together.

3 Claims, 3 Drawing Sheets

PLUG CONNECTOR

BACKGROUND OF THE INVENTION

1. Field of the Invention

The present invention relates to a plug connector, particularly to a charger plug having a compact telecommunication terminal, which can reliably transmit signals and can avoid misalignment when mating.

2. Background of the Invention

Referring to FIG. 1, a conductive terminal 10 of a conventional charger plug 1 is integrally made of a piece of metal and has a structure of a hollow cylinder. To avoid short-circuit, the hollow part of the conductive terminal 10 includes an insulative layer (not shown in the drawing). In other words, the conductive terminal 10 includes an insulative layer which is sandwiched between a pair of metal layers (not shown). Correspondingly, a charging unit 2 for mating with the charger plug 1 comprises a pair of insulative layers (not shown) and a metal layer (not shown) which is sandwiched between the two insulative layers. The thickness of the insulative layer of the charger plug 1 should be big enough so as not to be damaged when the charger plug 1 is frequently mated with the charging unit 2. Therefore, the charger plug 1 can not be made compact. Correspondingly, a connector mating with the charge plug can not become compact, and thus a mobile phone with such a connector can not become compact, either. Therefore, a charger plug having a compact structure for use with a mobile phone, is desired.

SUMMARY OF THE INVENTION

One objective of the present invention is to provide a charge plug having a compact structure. Therefore, a connector mated with the charge plug also can be made compact, and a mobile phone with such a connector also can be made compact.

Another objective of the present invention is to provide a charger plug which can avoid misalignment when connecting and reliably transmit signals.

CHARACTERISTICS OF THE INVENTION

According to one aspect of the present invention, a charger plug comprises an insulative casing, a terminal unit received in the insulative casing, a conductive terminal received in the terminal unit, and a shielding unit. The terminal unit includes a longitudinal portion and an elongated opening defined along one side of the longitudinal portion. The longitudinal portion of the terminal unit extends into the shielding unit. The elongated opening of the longitudinal portion and one side of the shielding unit cooperatively define a passageway.

According to another aspect of the present invention, the insulative casing and the terminal unit respectively include an embedding groove and a jut for reliably assembling the insulative casing and the terminal unit together.

DETAILED DESCRIPTION OF PREFERRED EMBODIMENTS

Figure 2:
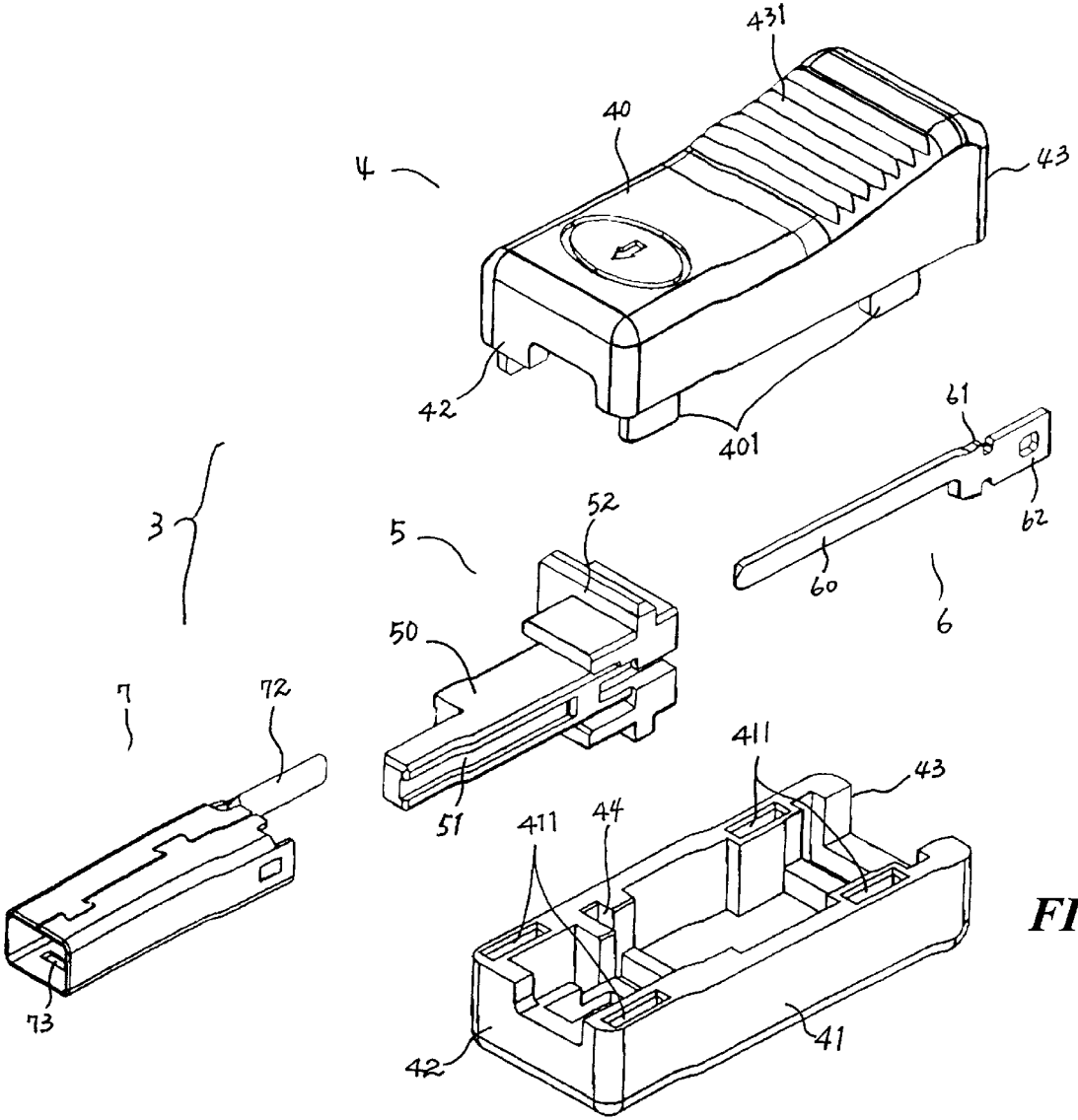
FIG. 2 is an exploded perspective view of a charger plug of the present invention.

Referring to FIG. 2, a charger plug 3 of the present invention comprises an insulative casing 4, a terminal unit 5, a conductive terminal 6 and a shielding unit 7. The insulative casing 4 includes a matching side 42 and a connecting side 43 opposite to the matching side 42. The insulative casing 4 includes a first casing 40 and a second casing 41. The first casing 40 forms four downwardly extending joining posts 401. Correspondingly, the second casing 41 defines four joining grooves 411. Each joining post 401 can be inserted into the corresponding groove 411 thereby assembling the first and second casing 40, 41 together. A plurality of embedding grooves 44 are defined in the first and second casing 40, 41 for fixing the terminal unit 5 (described in detail later) in place. The first casing 40 includes a surface 431 which is undulating for facilitating manual operation.

The terminal unit 5 is assembled between the first and the second casings 40, 41. The terminal unit 5 includes a longitudinal portion 50. The longitudinal portion 50 defines an elongated opening 51 along one side thereof for receiving the conductive terminal 6. The terminal unit 5 includes a pair of juts 52 for insertion into the embedding grooves 44 of the first and second casings 40, 41 thereby properly fixing the terminal unit 5 between the first and the second casings 40, 41.

Figure 6:
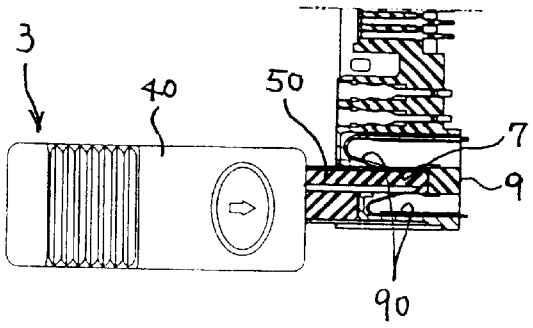
FIG. 6 is a cross-sectional view of the charger plug of FIG. 3 of the present invention and a charger socket connecting to the charger plug.

The conductive terminal 6 includes a contact part 60, an interference part 61 and a connecting part 62. The contact part 60 of terminal 6 is partly received in the elongated opening 51 of the terminal unit 5. Also referring to FIG. 4, when assembled, the connecting part 62 rearwardly extends out of the terminal unit 5 adjacent to the connecting side 43 of the insulative casing 4 for electrically connecting with a conductor (not shown). The contact part 60 of the terminal 6 is received in the elongated opening 51 of the terminal unit 5. The contact part 60 slightly extends out of the elongated opening 51 for electrically connecting with a corresponding terminal (not shown). The shielding unit 7 is intergratedly formed from a piece of metal and includes a rectangular joining groove 70. When assembled, the longitudinal portion 50 of the terminal unit 5 extends into the joining groove 70 of the shielding unit 7. The shielding unit 7 includes a second terminal 72 rearwardly extending for electrically connecting with a corresponding conductor (not shown). The shielding unit 7 forms a snap 73 for securing a charger socket 9 (shown in FIG. 6) when connecting.

Figure 1:
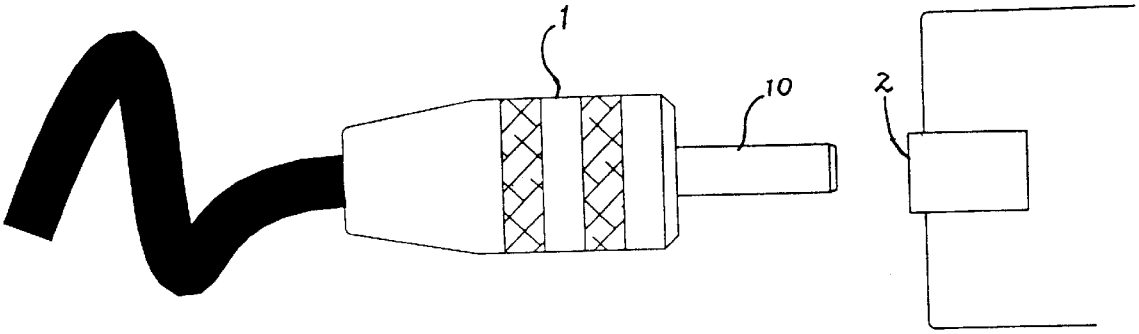
FIG.1 PRIOR ART
FIG. 1 is a side view of a conventional charger plug and a charging unit.
Figure 3:
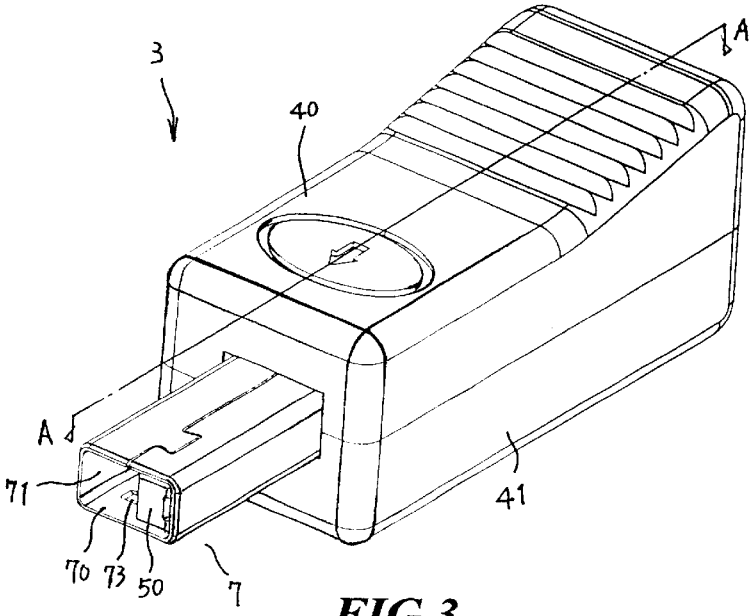
FIG. 3 is an assembled perspective view of FIG. 2.
Figure 4:
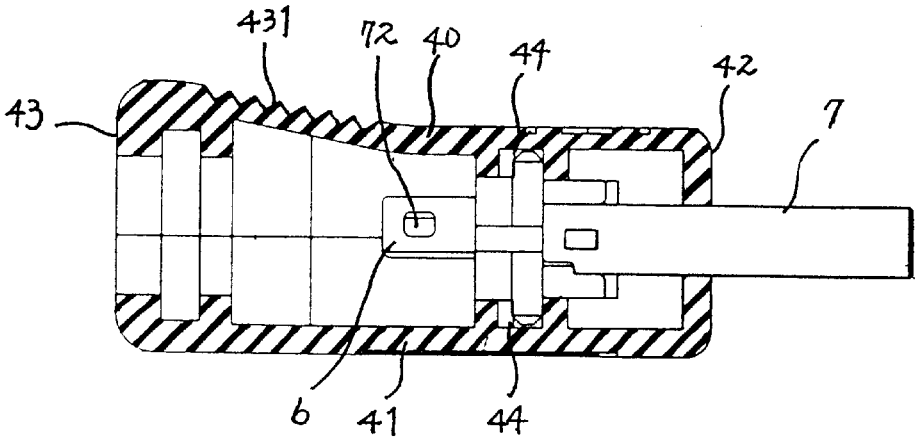
FIG. 4 is a cross-sectional view of a charger plug of FIG. 3 of the present invention taken along a line A—A in FIG. 3.
Figure 5:
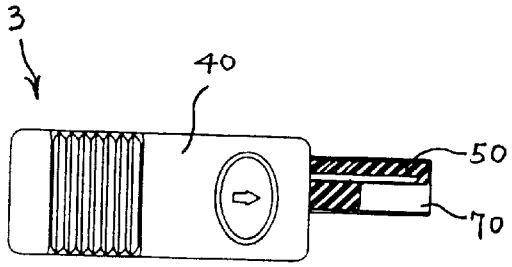
FIG. 5 is another cross-sectional view of the charger plug of FIG. 3 of the present invention.

Referring to FIGS. 2, 3, and 4, in assembly, the conductive terminal 6 is assembled into the terminal unit 5. The juts 52 of the terminal unit 5 are inserted into the embedding grooves 44 of the first and second casings 40, 41 thereby properly fixing the terminal unit 5 between the first and second casings 40, 41. Also referring to FIG. 5, the shielding unit 7 includes a connecting space 71 for receiving the longitudinal portion 50 of the terminal unit 5. Since the width of the connecting space 71 is larger than that of the longitudinal portion 50, a conductive terminal 90 (referring to FIG. 6) of charger socket 9 can extend into one side of the connecting space 71 opposite to the terminal unit 5. Such a structure avoids misalignment of the connection between the charger plug 3 and the charger socket 9. The conductive terminal 90 of the charger socket 9 electrically contacts the shielding unit 7. The snap 73 can secure the charger plug 3 to the charger socket 9 thereby reliably connecting the charger plug 3 and the charger socket 9 together. The conductive terminal 90 electrically contact the shielding unit 7. Such a charger plug 3 is obviously more compact than that of a prior art.

The invention has been described with exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretations so as to encompass all such modifications and similar arrangements.

What is claimed is:

1. A charger plug comprising:

an insulative casing including a first casing and a second casing, each of which has a matching side and a connecting side opposite to the matching side, a joining post disposed on the first casing, a joining groove disposed on the second casing, an embedding groove formed in one of the first and second casings; a terminal unit assembled between the first and second casings, the terminal unit including a longitudinal portion with an elongated opening along one side of the longitudinal portion and having a jut formed around the terminal unit;

a conductive terminal including a contact part, an interference part and a connecting part, said conductive terminal assembled into the elongated opening of the terminal unit, said connecting part extending out of the terminal unit and located at the connecting side of the insulating casing, said contact part received in the elongated opening of the terminal unit and slightly extending out of the elongated opening on the end; and a shielding unit made of metal and covering the longitudinal portion of terminal unit that defining a connecting space and a joining groove therein, and having a second terminal; wherein the jut is engaged within the embedding groove, and the joining post is engaged to the joining groove, thereby securing the terminal unit and the insulative casing together.

2. The charger plug as claimed in claim 1, wherein the joining groove of the shielding unit is rectangular.

3. The charger plug as claimed in claim 2, wherein the first casing includes an undulating surface.

* * * * *